US009050231B2

(12) United States Patent
Masters

(10) Patent No.: US 9,050,231 B2
(45) Date of Patent: Jun. 9, 2015

(54) SEAT-LIFT ASSEMBLY

(75) Inventor: Gary Masters, Shelbyville, KY (US)

(73) Assignee: L&P Property Management Company, South Gate, CA (US)

( * ) Notice: Subject to any disclaimer, the term of this patent is extended or adjusted under 35 U.S.C. 154(b) by 175 days.

(21) Appl. No.: 13/551,897

(22) Filed: Jul. 18, 2012

(65) Prior Publication Data

US 2014/0021760 A1 Jan. 23, 2014

(51) Int. Cl.

| | |
|---|---|
| ***A47C 1/031*** | (2006.01) |
| ***A61G 5/14*** | (2006.01) |
| ***A47C 1/0355*** | (2013.01) |
| *A47C 1/034* | (2006.01) |

(52) U.S. Cl.

CPC ..... *A61G 5/14* (2013.01); *A47C 1/0342* (2013.01); *A47C 1/0345* (2013.01); *A47C 1/0355* (2013.01)

(58) Field of Classification Search

CPC ... A47C 1/0345; A47C 1/0355; A47C 1/0342
USPC ..... 297/84, 85 M, 85 R, 85 L, 89
See application file for complete search history.

(56) References Cited

U.S. PATENT DOCUMENTS

| | | | | |
|---|---|---|---|---|
| 3,084,974 | A | 4/1963 | Belisle et al. | |
| 3,138,402 | A | 6/1964 | Heyl, Jr. et al. | |
| 3,233,938 | A | 2/1966 | Fletcher | |
| 3,622,198 | A | 11/1971 | Re | |
| 3,747,973 | A | 7/1973 | Re | |
| 3,813,150 | A * | 5/1974 | Katz et al. | 297/353 |
| 3,958,827 | A | 5/1976 | Re | |
| 4,083,599 | A | 4/1978 | Gaffney | |
| 4,195,878 | A | 4/1980 | Caldwell et al. | |
| 4,216,991 | A | 8/1980 | Holobaugh | |
| 4,306,746 | A | 12/1981 | Crum | |
| 4,365,836 | A | 12/1982 | Jackson et al. | |
| 4,418,957 | A | 12/1983 | Rogers, Jr. | |

(Continued)

FOREIGN PATENT DOCUMENTS

| | | |
|---|---|---|
| EP | 0468686 A1 | 1/1992 |
| EP | 2368458 A1 | 9/2011 |
| GB | 926157 | 5/1963 |

OTHER PUBLICATIONS

Notice of Allowance in U.S. Appl. No. 13/344,215, mailed Sep. 19, 2013, 15 pages.

(Continued)

*Primary Examiner* — Chi Q Nguyen
(74) *Attorney, Agent, or Firm* — Shook, Hardy & Bacon L.L.P.

(57) ABSTRACT

A seating unit that includes a seat-lift assembly adapted to move the seating unit between a closed and a seat-lift position is provided. The seat-lift assembly includes a drive linkage mechanism, and a lift linkage mechanism. The seat-lift assembly is attached to a seat linkage mechanism that includes a seat-mounting plate, a base plate coupled and a linear actuator for automating adjustment of the linkage mechanism. In operation, the drive linkage mechanism is moveably interconnected to the base plate and adapted to independently raise at least a first portion of the seat frame with respect to the base plate, the first portion being raised at a first rate, and the lift linkage mechanism is moveably interconnected to the seat-mounting plate, and adapted to independently raise at least a second portion of the seat frame with respect to the seat-mounting plate.

20 Claims, 6 Drawing Sheets

(56) References Cited

U.S. PATENT DOCUMENTS

| | | | | |
|---|---|---|---|---|
| 4,707,025 | A | 11/1987 | Rogers, Jr. | |
| 4,740,031 | A | 4/1988 | Rogers | |
| 4,786,107 | A | 11/1988 | Crockett | |
| 4,852,939 | A | 8/1989 | Krauska | |
| 4,863,215 | A | 9/1989 | Crum | |
| 5,072,988 | A | 12/1991 | Plunk | |
| 5,076,644 | A | 12/1991 | Northcutt | |
| 5,121,967 | A | 6/1992 | Rogers, Jr. | |
| 5,219,204 | A | 6/1993 | Bathrick et al. | |
| 5,265,935 | A | 11/1993 | Geisler et al. | |
| 5,312,153 | A | 5/1994 | Lin | |
| 5,466,046 | A | 11/1995 | Komorowski et al. | |
| 5,482,350 | A | 1/1996 | Komorowski et al. | |
| 5,651,580 | A | 7/1997 | LaPoint et al. | |
| 5,730,494 | A | 3/1998 | LaPointe et al. | |
| 5,772,278 | A | 6/1998 | Kowalski | |
| 5,975,627 | A | 11/1999 | LaPointe et al. | |
| 5,992,930 | A | 11/1999 | LaPointe et al. | |
| 6,000,758 | A | 12/1999 | Schaffner et al. | |
| 6,659,556 | B2 | 12/2003 | Pellerin | |
| 6,729,686 | B2 | 5/2004 | May | |
| 6,840,575 | B2 | 1/2005 | Hesse | |
| 6,871,910 | B2 | 3/2005 | Hale | |
| 7,497,512 | B2 | 3/2009 | White et al. | |
| 7,543,885 | B2 | 6/2009 | Pollard | |
| 7,575,279 | B2 | 8/2009 | Robertson | |
| 7,585,018 | B2 | 9/2009 | LaPointe et al. | |
| 7,631,937 | B2 | 12/2009 | Robertson | |
| 7,673,933 | B2 | 3/2010 | Lawson | |
| 7,766,421 | B2 | 8/2010 | Lawson | |
| 8,016,348 | B2 | 9/2011 | Hoffman et al. | |
| 8,123,289 | B2 | 2/2012 | Qiu et al. | |
| 8,308,228 | B2 | 11/2012 | Lawson et al. | |
| 8,398,165 | B2 | 3/2013 | Lawson | |
| 8,398,171 | B2 | 3/2013 | Lin et al. | |
| 8,419,122 | B2 * | 4/2013 | Lawson et al. | 297/85 M |
| 8,573,687 | B2 * | 11/2013 | Lawson et al. | 297/85 R |
| 2001/0035668 | A1 | 11/2001 | Gaffney et al. | |
| 2002/0149238 | A1 | 10/2002 | Hoffman et al. | |
| 2003/0015893 | A1 | 1/2003 | Hoffman | |
| 2003/0047973 | A1 | 3/2003 | Pellerin | |
| 2003/0057743 | A1 | 3/2003 | May | |
| 2006/0238007 | A1 | 10/2006 | Lin | |
| 2007/0257525 | A1 | 11/2007 | Wiecek | |
| 2008/0001442 | A1 | 1/2008 | Wiecek | |
| 2008/0111402 | A1 | 5/2008 | Crum | |
| 2008/0150329 | A1 | 6/2008 | Lawson | |
| 2011/0193373 | A1 | 8/2011 | Lawson et al. | |
| 2011/0304193 | A1 | 12/2011 | Murphy et al. | |
| 2012/0235449 | A1 | 9/2012 | Wiecek | |
| 2012/0299363 | A1 | 11/2012 | Crum | |

OTHER PUBLICATIONS

Non Final Office Action in U.S. Appl. No. 13/344,330, mailed Nov. 20, 2013, 36 pages.

International Search Report and Written Opinion for PCT/US2011/024211 mailed on Apr. 6, 2011.

Non-Final Office Action in U.S. Appl. No. 12/981,185 mailed Feb. 27, 2012, 11 pages.

Notice of Allowance in U.S. Appl. No. 12/981,185, mailed Jul. 10, 2012.

Notification of Transmittal of the International Search Report and the Written Opinion of the International Searching Authority, or the Declaration in PCT/US13/20273 mailed Mar. 1, 2013, 14 pages.

Notification of Transmittal of the International Search Report and the Written Opinion of the International Searching Authority, or the Declaration in PCT/US13/20277 mailed Mar. 1, 2013, 15 pp.

Non-Final Office Action in U.S. Appl. No. 13/344,215, mailed Jun. 5, 2013, 41 pages.

International Search Report and Written Opinion for PCT/US2013/051065, mailed Dec. 23, 2013, 18 pages.

Supplemental European Search Report, mailed Feb. 5, 2014.

Chinese Office Action dated Sep. 3, 2014 in Chinese Application No. 201110075861.2, 20 pages.

Notice of Allowance dated Sep. 19, 2014 in U.S. Appl. No. 13/344,330, 7 pages.

Non-Final Office Action dated Nov. 17, 2014 in U.S. Appl. No. 13/653,018, 7 pages.

* cited by examiner

SEAT-LIFT ASSEMBLY

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved seat-lift assembly developed over conventional seat-lift assemblies in the field that lift the entire seating unit off the floor. The improved seat-lift assembly of the present invention provides for raising the seat frame with respect to the seating unit.

Seat lifting units that exist, push a seating unit up from its base frame to assist the user to move into a standing position. In the case of reclining and lifting seating units, these existing seating units typically provide three basic positions (e.g., a standard, nonreclined closed position; an extended position; and a reclined position), and a seat-lift position as well. In the closed position, the seat resides in a generally horizontal orientation and the backrest is disposed substantially upright. Additionally, if the seating unit includes an ottoman attached with a mechanical arrangement, the mechanical arrangement is collapsed such that the ottoman is not extended. In the extended position, often referred to as a television ("TV") position, the ottoman is extended forward and the backrest is partly reclined to permit comfortable television viewing by an occupant of the seating unit. In the reclined position the backrest is positioned rearward from the extended position into an obtuse relationship with the seat for lounging or sleeping. In the seat-lift position, a seat linkage mechanism of the seating unit is typically adjusted to the closed position and a seat-lift assembly raises and tilts forward the seating unit in order to facilitate entry thereto and exit therefrom.

Yet, in order to provide the adjustment capability described above, these existing seat-lift assemblies require raising the entire seating unit off the floor. In particular, the geometry of these seat-lift assemblies imposes constraints on raising the seat frame with respect to the seating unit. Moreover, lifting the entire seating unit from its base frame creates an opportunity for persons, pets or other foreign objects to become trapped underneath when the seating unit is lowered. In view of the above, a more refined seat-lift assembly that achieves raising a seat frame with respect to a seating unit would fill a void in the current field of motion-upholstery technology. Accordingly, embodiments of the present invention pertain to a novel seat-lift assembly that is constructed in a simple and refined arrangement in order to provide suitable function while overcoming the above-described, undesirable features inherent within the conventional seat-lift assemblies.

BRIEF SUMMARY OF THE INVENTION

Embodiments of the present invention seek to provide a simplified seat-lift assembly that can be assembled to a single compact motor and that can be adapted to raise a seat frame with respect to a seating unit. In an exemplary embodiment, the compact motor in concert with the seat-lift assembly linkage mechanisms (e.g., drive linkage mechanism and lift linkage mechanism) can achieve full movement and sequenced adjustment of the seating unit when being automatically adjusted between the closed and seat-lift positions. The seat-lift assembly linkages may be configured to assist in sequencing the seating unit between a closed position and a seat-lift position, lifting the seat frame with respect to the seating unit, and thus curing other disadvantages appearing in the conventional designs.

Generally, embodiments of the present invention include the following components: a seat linkage mechanism including a pair of base plates in substantially parallel-spaced relation; a pair of seat-mounting plates in substantially parallel-spaced relation, a seat frame for supporting a seat; a pair of seat-lift assemblies including a pair of generally mirror-image drive linkage mechanisms each moveably interconnecting each of the base plates to the seat frame; and a pair of generally mirror-image lift linkage mechanisms each moveably interconnecting each of the seat-mounting plates to the seat frame. In operation, the seat-lift assembly is adapted to raise the seat frame with respect to the seating unit. The seat lift assemblies are typically disposed in opposing-facing relation about a longitudinally extending plane that bisects the seating unit between the seat arms. As such, the ensuing discussion will focus on only one of the seat lift assemblies, including each drive linkage mechanism, and each lift linkage mechanism, with the content being equally applied to the other, complimentary, seat lift assembly, drive linkage mechanism and lift linkage mechanism.

Typically the seat frame includes a rear cross member, a front cross member, a first lateral member, and a second lateral member, the drive linkage mechanism includes a drive attachment link, an extension link, a motor link, a bell crank and a drive sequence link, and the lift linkage mechanism includes a lift attachment link, a rear link, and a lifting link. In operation, the drive linkage mechanisms are adapted to raise at least a first portion of the seat frame with respect to each of the base plates and the lift linkage mechanisms are adapted to raise at least a second portion of the seat frame with respect to each of the seat-mounting plates.

In another embodiment, the seat of the seating unit extends between a seat linkage mechanism, adapted to translate the base plates with respect to the seat-mounting plates when the seat is lowered. In this instance, the seat-lift assembly is adapted to raise the seat frame independently of the seat linkage mechanism. Advantageously, during operation, the drive linkage mechanism is adapted to independently raise at least a first portion of the seat frame in relation to a respective base plate, the first portion of the seat frame being raised at a first rate, and the lift linkage mechanism is adapted to independently raise at least a second portion of the seat frame in relation to a respective seat-mounting plate, the second portion of the seat frame being raised at a second rate, wherein the first rate is different from the second rate.

In yet another embodiment, the seating unit includes a linear actuator that is drivably coupled to the seat-lift assembly and automatically raises the seat frame independently of the seat linkage mechanism. Generally, the linear actuator includes the following components: a motor mechanism; a track operably coupled to the motor mechanism; and a motor activator block that translates longitudinally along the track under automated control. In instances, the track includes a rear travel section, a center travel section, and a front travel section. Each of the travel sections correspond to a movement phase of the seating unit (e.g. upright phase, reclined phase, and seat-lift phase). In operation, during the upright phase, the motor activator block longitudinally translates along the center travel section, backward and forward. For example, the motor activator block may travel backward along the center travel section from a closed position (e.g., upright backrest with the footrest retracted) of the seating unit to an extended position (e.g., partially reclined backrest with the footrest extended) of the seating unit. Inversely, the motor activator block may travel forward along the center travel section from the extended position to the closed position of the seating unit. During a reclined phase, the motor activator block longitudinally translates along the rear travel section, backward and forward. The motor activator block may travel backward along the rear travel section from the extended position of the seating unit to a reclined position (e.g., backrest fully reclined with the footrest extended) of the seating unit. Inversely, the motor activator block may travel forward along the rear travel section from the reclined position to the extended position of the seating unit.

Lastly, during a seat-lift phase, the motor activator block longitudinally translates along the front travel section, forward and backward. For example, the motor activator block may travel forward along the front travel section from the closed position of the seating unit to a seat-lift position (e.g., seat frame raised with respect to the seating unit) of the seating unit. Inversely, the motor activator block may travel backward along the front travel section from the seat-lift position to the closed position of the seating unit. It is contemplated that, during the seat lift phase, the motor activator block longitudinally translates along the front travel section, thereby creating a lateral thrust at the activator shaft. Because, at this point, this longitudinal translation within the front travel section results in a detent condition of the seat linkage mechanism in the closed position, the lateral thrust at the activator shaft invokes adjustment of the seat-lift assemblies into or out of the seat-lift position, while maintaining the seat linkage mechanisms in the closed position. This adjustment into and out of the seat-lift position causes the seat frame to be raised and lowered with respect to the seating unit. As such, embodiments of the present invention introduce a seat-lift assembly that is configured to raise a seat frame with respect to the seating unit.

BRIEF DESCRIPTION OF THE SEVERAL VIEWS OF THE DRAWING

In the accompanying drawings, which form a part of the specification and which are to be read in conjunction therewith, and in which like reference numerals are used to indicate like parts in the various views.

DETAILED DESCRIPTION OF THE INVENTION

Figure 1:
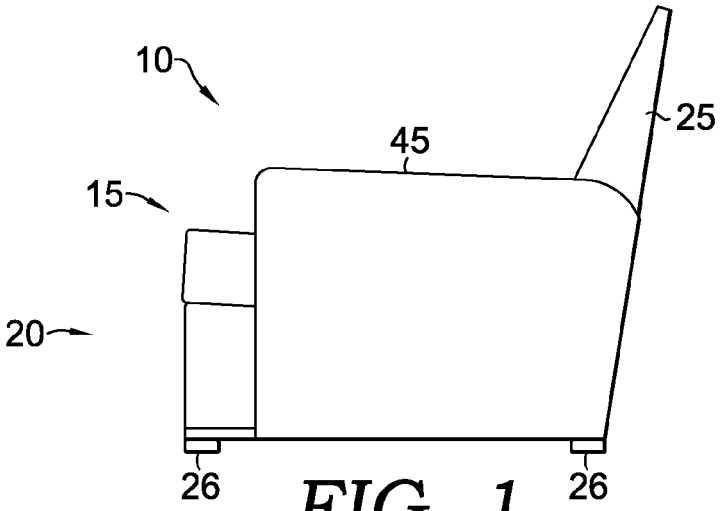
FIG. 1 is a diagrammatic lateral view of a seating unit in a closed position, in accordance with an embodiment of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

For purposes of this disclosure, the word "including" has the same broad meaning as the word "comprising." In addition, words such as "a" and "an," unless otherwise indicated to the contrary, include the plural as well as the singular. Thus, for example the requirement of "a feature" is satisfied where one or more features are present. Also, the term "or" includes the conjunctive, the disjunctive and both (a or b thus includes either a or b, as well as a and b). Also, the phrase "independently of" may refer to either not influenced or controlled by another, or not dependent or contingent upon something else happening. Thus, for example, a first set of linkage mechanisms may be raised independently of a second set of linkage mechanisms, meaning that the first set of linkage mechanisms may be raised without being controlled by the second set of linkage mechanisms; however it could also mean the first set of linkage mechanisms may be raised without being contingent on the second set of linkage mechanisms also being raised.

Generally, embodiments of this invention introduce technology within the motion furniture industry to improve operation and safety of a seating unit (e.g., a lifter-recliner-type seating unit). In embodiments, the operational improvements include: configuring a seat-lift assembly comprising a drive linkage mechanism and a lift linkage mechanism each adapted to raise at least a portion of a seat frame at different rates, and employing a single motor attached via one attachment point per side to power the seat frame into a seat-lift position. The safety improvement includes: configuring the drive linkage mechanism and the lift linkage mechanism to raise the seat frame with respect to seating unit, thereby eliminating an opportunity for persons, pets, or other foreign objects to become trapped underneath the seating unit when the seating unit is lowered.

FIGS. 1-4 illustrate a seating unit 10. It should be realized that the seating unit in FIGS. 1-4 is provided for demonstrative purposes only, thus, the present invention may be employed with any type of seating unit. Seating unit 10 has a seat 15, a backrest 25, legs 26 (e.g., floor-support bushings or a base assembly that rests upon an underlying surface), arms 45, a seat linkage mechanism 100, a footrest assembly 200, a motor assembly 300 (FIG. 5), a seat frame 600, a seat-lift assembly 500 comprising: a drive linkage mechanism 700, and a lift linkage mechanism 800.

Figure 2:
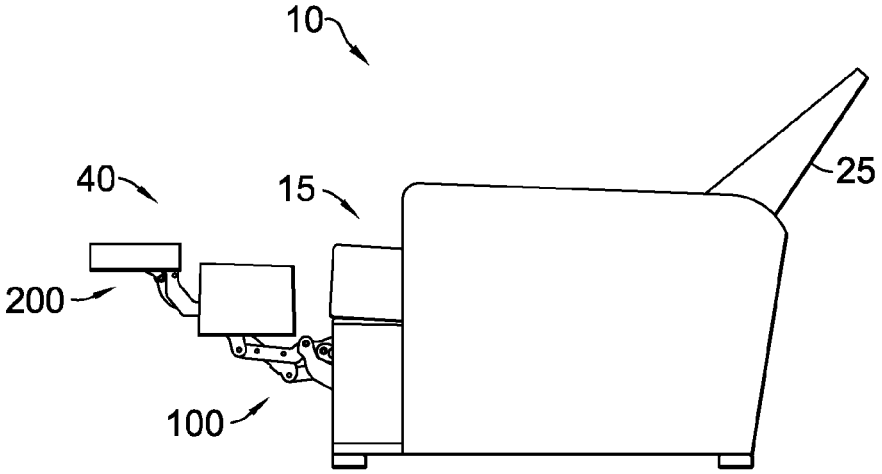
FIG. 2 is a diagrammatic lateral view of a seating unit in an extended position, in accordance with an embodiment of the present invention.
Figure 3:
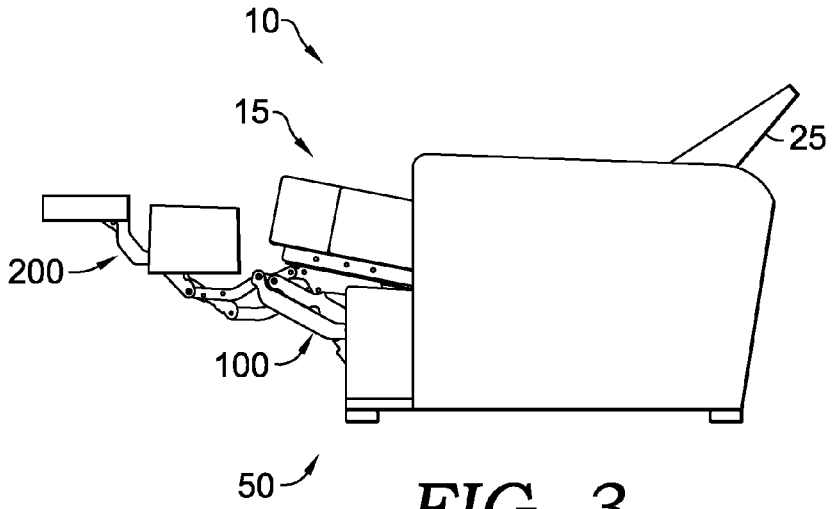
FIG. 3 is a diagrammatic lateral view of a seating unit in a reclined position, in accordance with an embodiment of the present invention.
Figure 4:
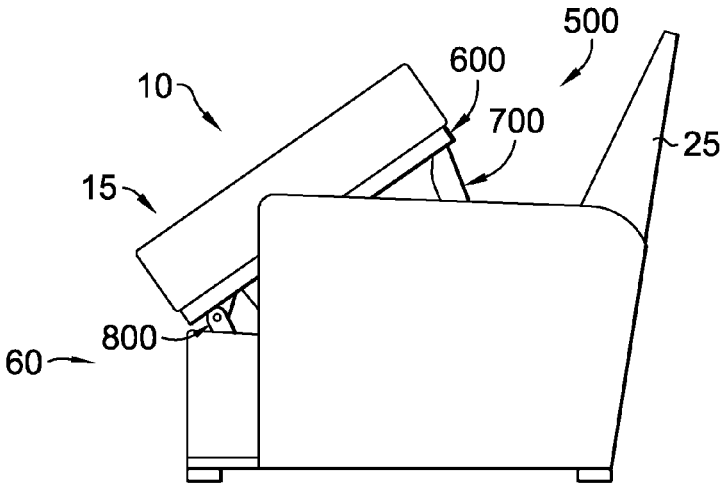
FIG. 4 is a diagrammatic lateral view of a seating unit in a seat-lift position, in accordance with an embodiment of the present invention.

As shown in FIGS. 2-4 the seating unit 10 is adjustable to an extended position 40, a reclined position 50, and a seat-lift position 60. FIG. 1 depicts the seating unit 10 adjusted to the closed position 20, which is a normal nonreclined sitting position with the seat 15 in a generally horizontal position and the backrest 25, generally upright and generally perpendicular to the seat 15. FIG. 2 depicts the seating unit adjusted to the extended position 40, which is often described as the television "TV" position. The footrest assembly 200 of the seating unit is fully extended, extracting an ottoman in front of the seating unit 10 and the backrest 25 partly reclines to permit relaxed television viewing by an occupant of the seating unit. In FIG. 3, the reclined position 50 is depicted; the backrest 25 is pivoted rearward from the extended position 40 to an obtuse relationship with the seat 15 for lounging or sleeping. The footrest assembly 200 is maintained in the fully extended position however the seating unit 10 is slightly adjusted to accommodate the change in the recline angle of the backrest 25.

Turning to FIG. 4, the seat-lift position 60 will now be described. When the seating unit 10 is adjusted to the seat-lift position 60, the seat linkage mechanism 100 (FIG. 5) is maintained in the closed position 20 of FIG. 1. In the prior art, the entire seating unit is lifted off the floor, exposing the various linkages, thereby creating an opportunity for persons, pets, or other foreign objects to become trapped underneath the seating unit when the seating unit is lowered. The general lack of independent control of the seat frame in other seating units allows for the occurrence or risk of injury. In contrast, the seat-lift assembly 500 raises only the seat frame 600 with respect to the seating unit 10 to assist with an occupant's ingress to and egress from the seating unit 10. In one instance, discussed below, adjustment of the seat-lift assembly 500 may be automated through use of a linear actuator within a motor assembly 300, as more fully described below.

Turning to FIGS. 5-8, exemplary configurations of a seat-lift assembly 500 for the seating unit 10 (hereinafter "seating unit") are illustrated and will now be discussed. With initial reference to FIGS. 5-6, a perspective view of the seat-lift assembly 500 in the seat-lift position 60 is shown, in accordance with an embodiment of the present invention. In embodiments, the seat-lift assembly 500 may be interconnected with a seat linkage mechanism 100 that includes a seat-mounting plate 400 and a base plate 410 and powered by a linear actuator included within the motor assembly 300. In one embodiment, the seat linkage mechanism 100 is arranged to articulately actuate and control movement of the seating unit, typically providing three basic positions (e.g., a standard, nonreclined closed position; an extended position; and a reclined position), for example, the seat linkage mechanism 100 is adjusted to the closed position 20 (see FIG. 1). Similarly, the seat-lift assembly 500 is also configured to adjust the seating unit, for example, into and out of the seat-lift position 60 (see FIG. 4). The seat-mounting plate 400 is configured to fixedly mount to the seat of the seating unit 10 and, in conjunction with an opposed seat-mounting plate 400, defines a seat support surface. The seat-lift assembly 500 is coupled to a mirror-image seat-lift assembly (not shown) via a seat frame 600 for supporting a seat of the seating unit. In general, the seat of the seating unit extends between the seat linkage mechanism 100 and the seat-lift assembly 500 is attached to the seat linkage mechanism 100, the seat-lift assembly 500 being adapted to raise the seat with respect to the seat linkage mechanism 100. Further, the seat-lift assembly 500 includes links that couple a single-motor linear actuator of the motor assembly 300 to the seat-lift assembly 500, thereby facilitating the raising movement of the seat-lift assembly 500 upon actuation of the linear actuator.

In addition, the seat-lift assembly 500 comprises a plurality of linkages (e.g., linkages of the drive linkage mechanism 700 or the lift linkage mechanism 800 described below) that are arranged to actuate and control movement of the seat frame 600 during adjustment between the closed position 20 to the seat-lift position 60. The linkages of the seat-lift assembly 500 are adapted to raise the seat with respect to seat linkage mechanism 100. Further, the linkages of the seat-lift assembly 500 may be pivotably interconnected to the seat-mounting plate 400 or base plates 410 of the seat linkage mechanism 100. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well known in the furniture-manufacturing industry.

In a particular example, the articulating joints (e.g., rotatable and pivotable couplings) are incorporated within the seat-lift assembly 500 (e.g., rivets). This feature of providing the articulating joints within the seat-lift assembly 500, minimizes repair costs associated with wear, as the more expensive welded assemblies will not be exposed to wear. Generally, in nonmoving connections most other fasteners are standard bolts.

Also, the shapes of the linkages and the brackets may vary as desired, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements (such as intervening elements) may also be present.

Generally, the seat-lift assembly 500 guides the raising of the seat frame 600. In an exemplary configuration, these movements are controlled by two sets of linkage mechanisms (e.g., drive linkage mechanism 700 and lift linkage mechanism 800). Each of the drive linkage mechanisms 700 and the lift linkage mechanisms are a pair of essentially mirror-image linkage mechanisms (one of each which is shown herein and indicated by reference numeral 700 and 800 respectively), which comprise an arrangement of pivotably interconnected linkages. The linkage mechanisms are typically disposed in opposing-facing relation about a longitudinally-extending plane that bisects the seating unit. As such, the ensuing discussion will focus on only one of the drive linkage mechanisms 700 and the lift linkage mechanism 800, with the content being equally applied to the other, complimentary, linkage assembly.

With continued reference to FIG. 5, the seat frame 600 will now be discussed. Typically, the seat frame 600 serves as a structure around which the seat is positioned. The seat frame 600 includes a rear cross member 610, a front cross member 620, a first lateral member 630 and a second lateral member (not shown). These members 610, 620, 630 may be formed from square metal tubing, or any other material used in the furniture-manufacturing industry that exhibits rigid properties. The rear cross member 610 and the front cross member 620 serve as crossbeams that span between and couple together the first lateral member 630 and the second lateral member. Generally, the rear cross member 610 is oriented in substantially parallel-spaced relation to the front cross member 620. Also, the first lateral member 630 is oriented in substantially parallel-spaced relation to the second lateral member. Further, the rear cross member 610, the front cross member 620, first lateral member 630 and the second lateral member (not shown) may be fixedly attached (e.g., welded or fastened) directly or indirectly through intervening links to each other or to the drive linkage mechanism 700 or the lift linkage mechanism 800. In one embodiment, the rear cross member 610 of the seat frame 600 is coupled to the drive linkage mechanism 700 and the first lateral member 630 of the seat frame 600 is coupled to the lift linkage mechanism 800.

Further, as more fully discussed below, the linear actuator of the motor assembly 300 controls movement of the seat-lift assembly 500 and is drivably coupled to the seat-lift assembly 500 to raise the seat with respect to the seating unit. During adjustment of seat-lift assembly, the drive linkage mechanism 700 is adapted to incrementally raise the seat frame 600 at a rate faster than the lift linkage mechanism 800 is adapted to incrementally raise the seat frame 600, causing the seat frame to raise and tilt to the seat-lift position that facilitates entry and egress to the seating unit. In other words, the linear actuator is configured to automatically raise the seat frame independently of the seat linkage mechanism.

With continued reference to FIG. 5, an automated version of the seating unit, which utilizes a single-motor linear actuator, is illustrated and will now be discussed via the embodiments below. In an exemplary embodiment, the seat-lift assembly is drivably coupled to the linear actuator of the motor assembly 300, which automatically raises and lowers the seat frame into and out of the seat-lift position with respect to the seat unit. The motor assembly 300 includes a rear motor bracket 315, a motor mechanism 320, a front motor bracket 325, a track 330, a motor activator block 340, an activator shaft 350, and an activator mounting plate 360.

This "linear actuator" is comprised of the motor mechanism 320, the track 330, and the motor activator block 340 and is drivably coupled to the seat-lift assembly 500. The motor mechanism 320 is protected by a housing. The motor mechanism 320 and the motor activator block 340 are slidably connected to each other via the track 330. The front motor bracket 325 is fixedly attached to a front section of the track 330. The activator shaft 350 spans between and couples to the seat-lift assembly and the opposed, counterpart, mirror-image linkage mechanism (not shown). Also, the activator shaft 350 includes a pair of ends, where each of the ends of the activator shaft 350 is fixedly coupled to an activator mounting plate 360. The activator mounting plate 360 may be pivotably coupled to the seat-lift assembly 500. For instance, the activator mounting plate 360 may be pivotably coupled with the seat-lift assembly via a pivotable interface at the activator mounting plate 360, where the pivotable interface may comprise at least one of bearings, interlocking bushings, or any other device known in the furniture-fabrication industry that enables one component to pivot with respect to another component.

Figure 5:
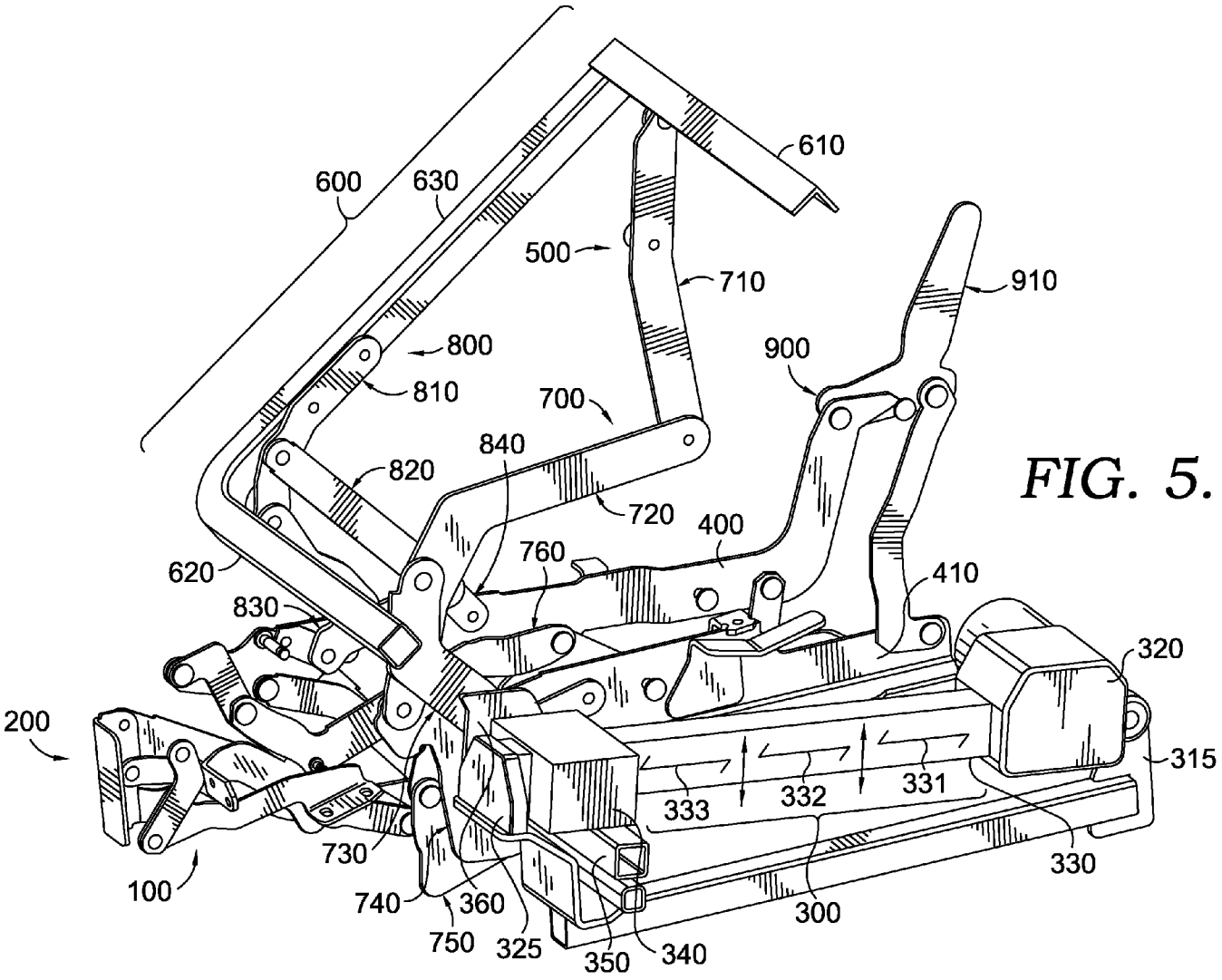
FIG. 5 is a perspective view of a seat-lift assembly in the seat-lift position illustrating a linear actuator for providing motorized adjustment of the seating unit, in accordance with an embodiment of the present invention.

As discussed above, the activator shaft 350 spans between and couples together the seat-lift assembly 500 shown in FIG. 5 and its counterpart, mirror-image seat-lift assembly (not shown). In embodiments, the activator shaft 350 functions as a crossbeam and may be fabricated from metal stock (e.g., formed sheet metal). Similarly, a seat-mounting plate 400, a base plate 410, and a plurality of other links that comprise the seat linkage mechanism 100 may be formed from metal stock, such as stamped, formed steel. However, it should be understood and appreciated that any suitable rigid or sturdy material known in the furniture-manufacturing industry may be used in place of the materials described above.

In operation, the motor activator block 340 travels toward or away from the motor mechanism 320 along the track 330 during automated adjustment of the linear actuator. In a particular embodiment, the motor mechanism 320 causes the motor activator block 340 to longitudinally traverse, or slide, along the track 330 under automated control. This sliding action produces a rotational and/or lateral force on the activator shaft 350, which, in turn, generates movement of the seat-lift assembly 500 via the activator mounting plate 360. As more fully discussed below, the sliding action is sequenced into a reclined phase, an upright phase, and a seat-lift phase. In an exemplary embodiment, the reclined phase, the upright phase, and the seat-lift phase are mutually exclusive in stroke. In other words, the linear actuator stroke of the reclined phase fully completes before the linear actuator stroke of the upright phase commences, and vice versa. Likewise, the linear actuator stroke of the upright phase fully completes before the linear actuator stroke of the seat-lift phase commences, and vice versa.

Initially, the track 330 is operably coupled to the motor mechanism 320 and includes a rear travel section 331, a center travel section 332, and a front travel section 333. The motor activator block 340 translates longitudinally along the track 330 under automated control of the motor mechanism 320 such that the motor activator block 340 translates within the rear travel section 331 during the reclined phase, the center travel section 332 during the upright phase, and the front travel section 333 during the seat-lift phase. As illustrated in FIG. 5, the lines separating the rear travel section 331, the center travel section 332, and the front travel section 333 indicate that the travel sections 331, 332, and 333 abut, however, they do not overlap. It should be realized that the precise lengths of the travel sections 331, 332, and 333 are provided for demonstrative purposes only, and that the length of the travel sections 331, 332, and 333, or ratio of the linear actuator stroke allocated to each of the rear phase, center phase, and front phase, may vary from the length or ratio depicted.

Generally, the upright phase involves continued longitudinal translation of the motor activator block 340, but along the center travel section 332 of the track 330. This translation within the center travel section 332 generates a rotational movement of the seating unit linkage mechanisms, thereby invoking the upright phase movement of the seating unit. In operation, the upright phase in a backward direction moves the seating unit from a closed position to an extended position, in this regard, the upright-phase movement extracts the footrest assembly 200 to a fully extended position and in a connected action reclines a back-mounting link 910 of a seat adjustment assembly 900. Inversely, the upright phase, in a forward direction, moves the seating unit from an extended position to a closed position, in this regard, the upright phase movement retracts the footrest assembly 200 and in a connected action adjusts the back-mounting link 910 to an upright position. Once the stroke of the upright phase is substantially completed, in a backward direction, the reclined phase may occur, and similarly, once the stroke of the upright phase is substantially completed in the forward direction, the seat-lift phase may occur.

From the extended position, the reclined phase involves longitudinal translation of the motor activator block 340 along the rear travel section 331 of the track 330, which generates a rotational movement of the seating unit linkage mechanisms, thereby invoking the reclined phase movement of the seating unit. In operation, the reclined phase in a backward direction moves the back-mounting link 910 to a fully reclined position and maintains the footrest assembly 200 in the fully extended position, and the seating unit is slightly adjusted to accommodate the change in the back-mounting link 910. Inversely, the reclined phase, in a forward direction, moves the back-mounting link 910 to a partly reclined position and in a connected action maintains the footrest assembly 200 in the fully extended position. Once the stroke of the reclined phase is substantially completed, in a in the forward direction, the upright phase may occur.

From the upright position, the seat-lift phase involves longitudinal translation of the motor activator block 340 along the front travel section 333 of the track 330, which generates a rotational movement of the seating unit linkage mechanisms, thereby invoking the seat-lift phase movement of the seating unit. In operation, the seat-lift phase in a forward direction moves the seating unit from a closed position to a seat-lift position, in this regard; the seat-lift phase raises the seat frame 600 with respect to the seat linkage mechanisms 100. Inversely, the seat-lift phase, in a backward direction, moves the seating unit from a seat-lift position to a closed position, in this regard, the seat-lift phase movement lowers the seat frame 600 with respect to the seat linkage mechanisms 100. Once the stroke of the seat-lift is substantially completed, in a backward direction, the upright phase may occur.

It is contemplated that the motor activator block 340 longitudinally translates forward along the front travel section 333 of the track 330 with respect to the motor mechanism 320, while the motor mechanism 320 remains generally fixed in space. This longitudinal translation of the motor activator block 340 along the front travel section 333 creates a lateral thrust that secures the seat linkage mechanism 100 in a detent condition. Consequently, the longitudinal translation along the front travel section 333 of the track 330 generates a forward thrust at the activator shaft 350, which invokes adjustment of the seat-lift assembly 500 into or out of the seat-lift position while maintaining the pair of seat linkage mechanisms 100 in the closed position. That is, the stroke of the seat-lift phase raises the seat frame with respect to the seating mechanism, thus, adjusting the seat-lift assembly 500 between a collapsed configuration (see FIG. 1) and an expanded seat-lift position (see FIGS. 4 and 5) that facilitates entry and egress to the seating unit. It should be understood that raising and lowering the seat frame 600 with respect to any of the seat unit linkage mechanisms may also refer to raising and lowering the seat frame 600 independently of the particular seat unit linkage mechanism.

Further, although a particular configuration of the combination of the motor mechanism 320, the track 330, and the motor activator block 340 has been described, it should be understood and appreciated that other types of suitable devices that provide sequenced adjustment may be used, and that embodiments of the present invention are not limited to a linear actuator as described herein. For instance, the combination of the motor mechanism 320, the track 330, and the motor activator block 340 may be embodied as a telescoping apparatus that extends and retracts in a sequenced manner.

Advantageously, the single-motor lift mechanism (i.e., interaction of the single linear actuator within the motor assembly 300 and the seat-lift assembly 500) in embodiments of the present invention allows for the seat-lift assembly 500 to raise a seat frame 600 with respect to the seating unit. Further, configuring the drive linkage mechanism 700 and the lift linkage mechanism 800 to raise the seat frame with respect to the seating unit, eliminates the opportunity for persons, pets, or other foreign objects to become trapped underneath the seating unit when the seating unit is lowered. Moreover, the single-motor lift mechanism, that automatically raises the seat frame using the seat-lift assembly 500, is attached via a one attachment point per side to power the seating unit into a seat-lift position.

Figure 6:
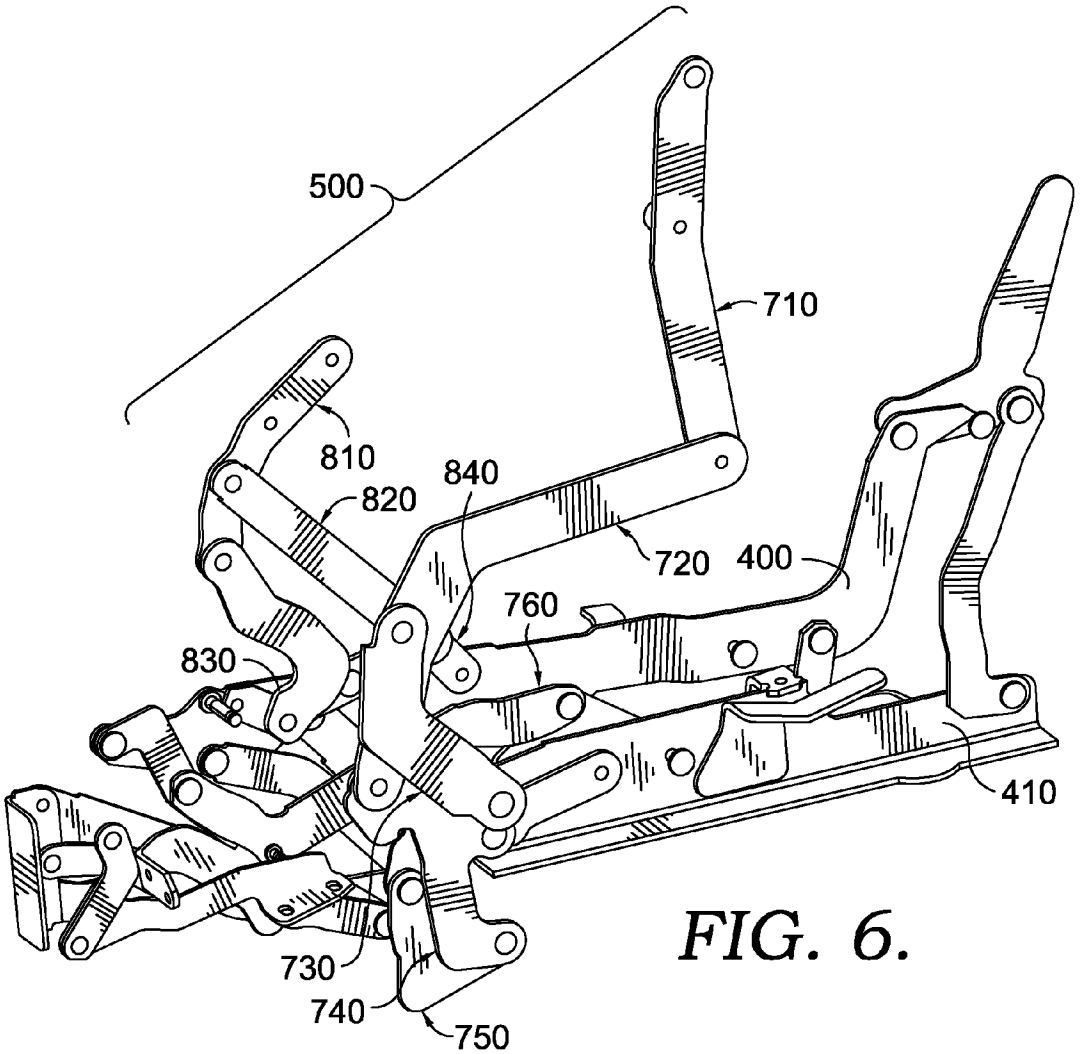
FIG. 6 is a view similar to FIG. 4, but without the linear actuator and seat frame, in accordance with an embodiment of the present invention.
Figure 7:
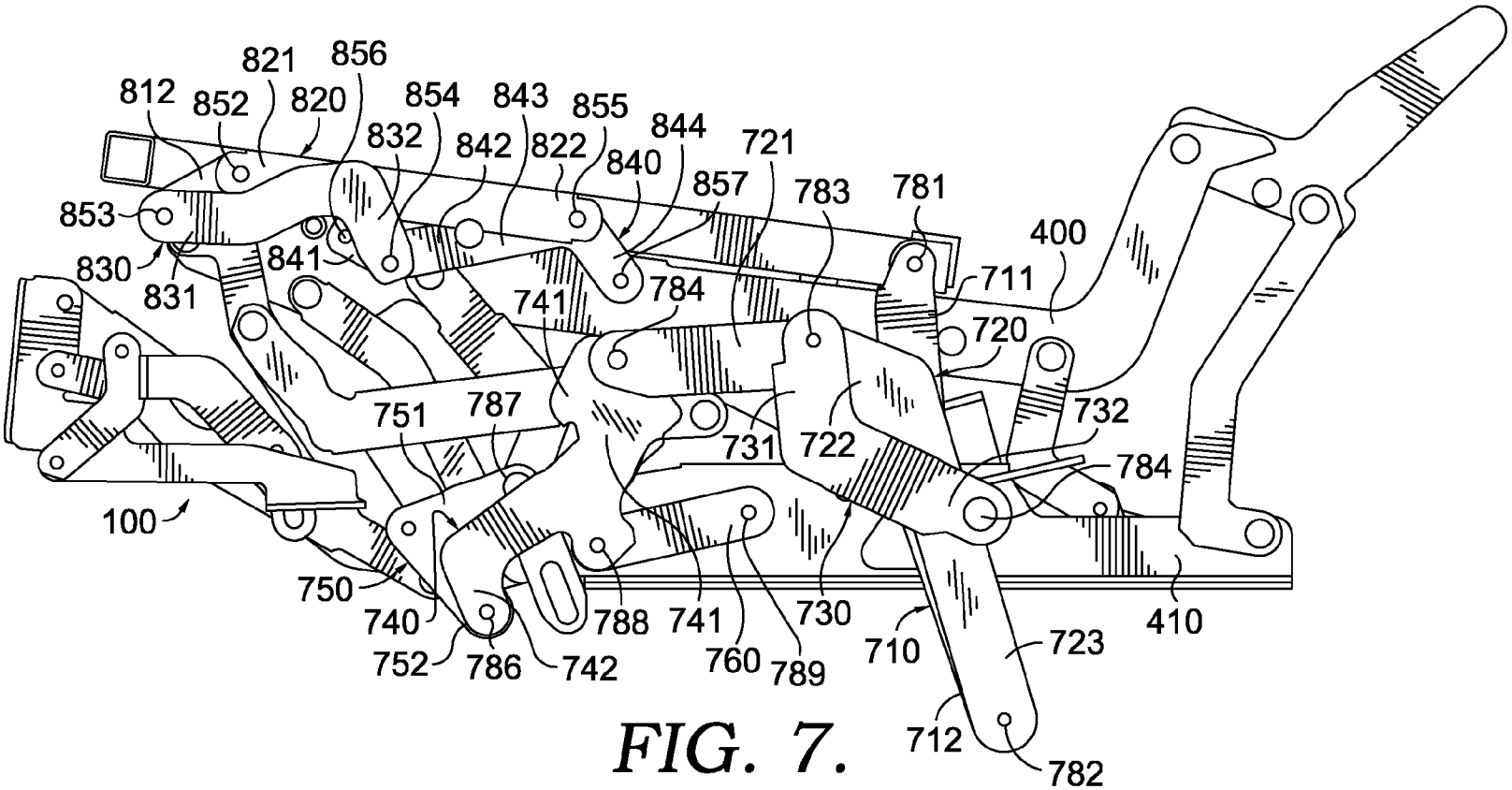
FIG. 7 is a diagrammatic lateral view of the seat-lift assembly in the closed position from a vantage point external to the seating unit, in accordance with an embodiment of the present invention.
Figure 8:
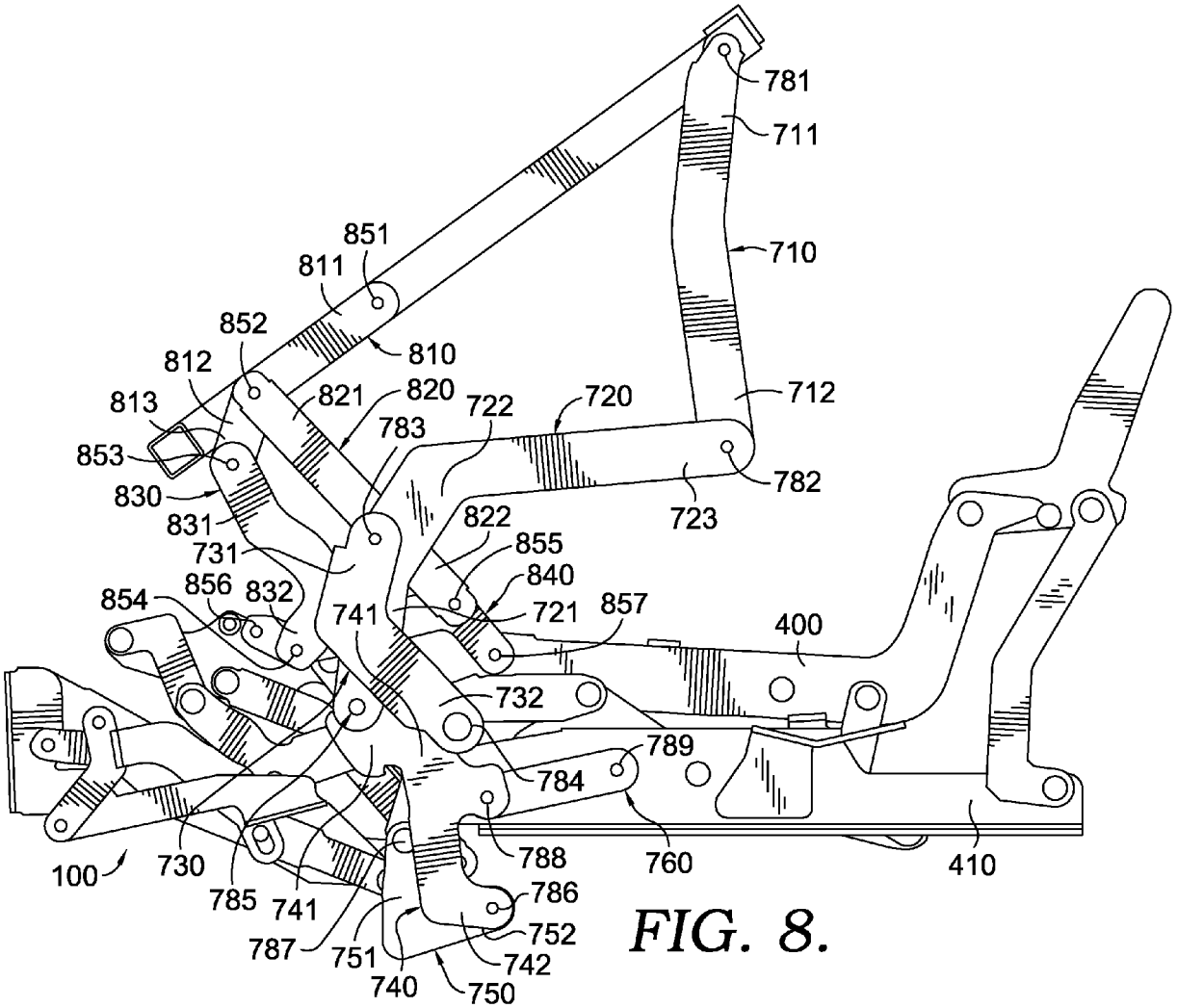
FIG. 8 is a diagrammatic lateral view of the seat-lift assembly in the seat-lift position from a vantage point external to the seating unit, in accordance with an embodiment of the present invention.

Turning to FIGS. 6-8, the components of the seat-lift assembly 500 will now be discussed in detail. The seat-lift assembly 500 includes the drive linkage mechanism 700 and lift linkage mechanism 800 which are used to raise the seat frame 600 (discussed above). We will first discuss the drive linkage mechanism 700 and then the lift linkage mechanism 800. Generally, the drive linkage mechanism 700 moveably interconnects the base plate 410 to the seat frame 600. The drive linkage mechanism 700 includes a drive attachment link 710, an extension link 720, a motor link 730, a bell crank 740, and a drive sequence link 750. The drive attachment link 710 includes a top portion 711 (FIG. 8) and a bottom portion 712. The top portion 711 of the drive attachment link 710 is rotatably coupled to the seat frame 600 at pivot 781. In embodiments, a bracket link (not shown) is fixedly attached to the seat frame 600 at the rear cross member 610 and rotatably attached to the top portion 711 of the drive attachment link 710. The extension link 720 includes a front portion 721, a mid portion 722 and a rear portion 723. The rear portion 723 of the extension link 720 is pivotably coupled to the bottom portion 712 of the drive attachment link 710 at pivot 782. The motor link 730 includes a top portion 731 and a bottom portion 732. The top portion 731 of the motor link 730 is rotatably coupled to the mid portion 722 of the extension link 720 at pivot 783 and the bottom portion 732 of the motor link 730 is pivotably coupled to the motor assembly 300 at pivot 784. The bell crank 740 includes a top portion 741 and a bottom portion 742. The top portion 741 of the bell crank 740 is rotatably coupled to the front portion 721 of the extension link 720 at pivot 785. The drive sequence link 750 includes a top portion 751 and a bottom portion 752. The bottom portion 752 of the drive sequence link 750 is rotatably coupled to the bottom portion 742 of the bell crank 740 at pivot 786 and rotatably coupled to the base plate 410 at pivot 787. In embodiments, the drive linkage mechanism 700 further includes a pivot link 760 that is rotatably attached to the bell crank 740 at pivot 788 and fixedly attached to the base plate at pivot 789.

In operation, the drive attachment link 710, the extension link 720, the motor link 730, the bell crank 740, and the drive sequence link 750 are configured to swing in a generally upward relation when the linear actuator automatically adjusts the seating unit to raise the seat frame with respect to the seating unit. The configuration of the drive linkage mechanism 700 allows the seat frame 600 to be raised with respect to the base plates 410. The drive linkage mechanism 700 may independently raise the seat frame at a first portion of the seat frame. Further, the drive linkage mechanism 700 may raise the first portion of the seat frame at a first rate. As discussed above, movement into and out of the seat-lift position 60 occurs in the third phase of the linear actuator stroke in which the motor activator block 340 longitudinally traverses the track 330 with the front travel section 333.

With reference to the lift linkage mechanism 800, it includes a lift attachment link 810, a rear link 820, and a lifting link 830. Generally, the lift linkage mechanism 800 moveably interconnects the seat-mounting plate 400 to the seat frame 600. The lift attachment link 810 includes a top portion 811, a mid portion 812, and a bottom portion 813. The top portion 811 of the lift attachment link 810 is fixedly attached to the seat frame 600. The rear link 820 includes an upper end 821 and a lower end 822 at pivot 855. The upper end 821 of the rear link 820 is rotatably coupled to the mid portion 812 of the lift attachment link 810 at pivot 852. The lifting link 830 includes an upper end 831 and a lower end 832. The upper end 831 of the lifting link 830 is pivotably coupled to the bottom portion 813 of the lift attachment link 810 at pivot 853. In embodiments, a mounting link 840 includes a forward portion 841, a forward lift portion 842, a rearward lift portion 843, and a rearward portion 844. The forward lift portion 842 of the mounting link 840 is rotatably coupled to the lower end 832 of the lifting link 830 at pivot 854 and the rearward lift portion 843 is rotatably coupled to the lower end 822 of the lifting link 830 at pivot 855. The forward portion 841 and the rearward portion 844 both of the mounting link 840 are coupled to the seat-mounting plate 400 at pivot 856 and pivot 857 respectively.

In operation, the lift attachment link 810, the rear link 820, and the lifting link 830 are configured to swing in an upward relation when the linear actuator automatically adjusts the seating unit to raise the seat frame with respect to the seating unit. The configuration of the lift linkage mechanism 800 allows the seat frame 600 to be raised with respect to the seat-mounting plate. The lift linkage mechanism 800 may independently raise the seat frame 600 at a second portion of the seat frame. Further, the lift linkage mechanism 800 may raise the second portion of the seat frame 600 at a second rate. As discussed above, movement into and out of the seat-lift position occurs in the third phase of the linear actuator stroke in which the motor activator block 340 longitudinally traverses the track 330 with the front travel section 333.

Generally, the drive linkage mechanism 700 and the lift linkage mechanism 800 are designed such that the drive linkage mechanism 700 incrementally raises the first portion of the seat frame 600 at a first rate and the lift linkage mechanism 800 incrementally raises the second portion of the seat frame 600 at a second. In embodiments, the first rate is different from the second rate and may be faster than the second rate. The rate may generally refer to the speed, progress, or relative rapidity in moving the seat frame 600 from the closed position 20 to the seat-lift position 60. The rates of each linkage mechanism may also occur simultaneously or in succession of each other during the raising of the seat frame 600. The different rates at which the drive linkage mechanism 700 and the lift linkage mechanism 800 raise the seat frame 600 provide a forward tilt to the first portion of the seat frame 600. The raising and tilting of the seating frame facilitates the occupant's ingress to and egress from the seating unit.

As discussed above, when desiring to move from the closed position 20 (FIG. 1) to the seat-lift position 60 (FIG. 4), the occupant may invoke an actuation at the hand-operated controller that sends the control signal with instructions to the linear actuator to carry out a stroke in the seat-lift phase. Upon receiving the control signal from the hand-operated controller, the linear actuator slides the motor activator block 340 forward with respect to the motor mechanism 320 held relatively fixed in space. This sliding action of the motor activator block 340 rotates the motor link 730 about the rotational interface with the activator mounting plate 360. This clockwise rotation of the motor link 730 triggers third-phase movement at the motor link 730.

This third-phase movement of the motor link 730 pushes the extension link 720 counter-clockwise at pivot 783 in a generally upward direction which in turn rotatably pulls the bell crank 740 at pivot 785 and the drive sequence link 750 at pivot 786 upward and also thrusts the drive attachment link 710 upward at pivot 782. Each linkage acts as leverage to raise the seat frame 600 at a first portion. The drive linkage mechanism 700 at pivot 781 of the drive attachment link 710 raises the seat frame 600 at pivot 781, at a first rate. This third-phase movement of the motor link 730 also pushes the lift attachment link 810 counter-clockwise and generally upwards, in turn, pulling and rotating the rear link 820 and the lifting link 830 about pivots 852 and 853 respectively. The rear link 820 and the lifting link 830 provide leverage support for the lift attachment link 810 to raise the seat frame 600 about a second portion, at pivot 851, at a second rate. As such, the seat frame 600 is raised via the drive linkage mechanism 700 and raised via the lift linkage mechanism 800 both independently of and with respect to the seat linkage mechanism 100. Further, in a manner that is reverse to the steps discussed above, with reference to operation of the seat-lift assembly 500, the seat-lift position 60 to the closed position 20, the automated force of the linear actuator upon the activator shaft 350 and activator mounting plate 360 in the seat-lift phase of the linear actuator stroke forces the drive linkage mechanism 700 and lift linkage mechanism 800 in a generally downward direction with respective to the pair seat linkage mechanisms 100.

It should be understood that the construction of the seat-lift assembly 500 lends itself to enable the various links and brackets to be easily assembled and disassembled from the remaining components of the seating unit. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seating unit, comprising:

a backrest;

a pair of arms;

a pair of base plates in substantially parallel-spaced relation;

a pair of seat-mounting plates in substantially parallel-spaced relation to each of the base plates, respectively;

a seat frame for supporting a seat of the seating unit;

a pair of generally mirror-image drive linkage mechanisms each moveably interconnecting each of the base plates to the seat frame, wherein the pair of generally mirror-image drive linkage mechanisms are operably decoupled from the arms and the backrest to raise at least a first portion of the seat frame with respect to each of the base plates; and a pair of generally mirror-image lift linkage mechanisms each moveably interconnecting each of the seat-mounting plates to the seat frame, wherein the pair of generally mirror-image lift linkage mechanisms are operably decoupled from the arms and the backrest to raise at least a second portion of the seat frame with respect to each of the seat-mounting plates.

2. The seating unit of claim 1, wherein the seat frame comprises a rear cross member, a front cross member, a first lateral member, and a second lateral member.

3. The seating unit of claim 2, wherein the rear cross member of the seat frame is coupled to the drive linkage mechanisms and the first lateral member of the seat frame is coupled to the lift linkage mechanisms.

4. The seating unit of claim 3, wherein the first portion of the seat frame comprises the rear cross member of the seat frame and the second portion of the seat frame comprises the first lateral member of the seat frame.

5. The seating unit of claim 1, wherein the drive linkage mechanisms are adapted to incrementally raise the first portion of the seat frame at a rate faster than the lift linkage mechanisms are adapted to incrementally raise the second portion of the seat frame.

6. The seating unit of claim 1, wherein each of the drive linkage mechanisms comprises:

a drive attachment link that includes a top portion and a bottom portion, wherein the top portion of the drive attachment link is rotatably coupled to the rear portion of the seat frame;

an extension link that includes a front portion, a mid portion, and a rear portion, wherein the rear portion of the extension link is pivotably coupled to the bottom portion of the drive attachment link;

a motor link that includes a top portion and a bottom portion, wherein the top portion of the motor link is rotatably coupled to the mid portion of the extension link;

a bell crank that includes a top portion and a bottom portion, wherein the top portion of the bell crank is rotatably coupled to the front portion of the extension link; and a drive sequence link that includes a top portion and a bottom portion, the bottom portion of the drive sequence link is rotatably coupled to the bottom portion of the bell crank and rotatably coupled to a respective base plate.

7. The seating unit of claim 6, wherein each of the drive linkage mechanisms further comprises a pivot link, wherein the pivot link is fixedly attached to a respective base plate and the bottom portion of the bell crank is rotatably attached to the pivot link.

8. The seating unit of claim 6, wherein each of the drive linkage mechanisms further comprises a bracket link that is fixedly attached to the seat frame and rotatably attached to the top portion of the drive attachment link.

9. The seating unit of claim 1, wherein each of the lift linkage mechanisms comprises:

a lift attachment link that includes a top portion, a mid portion, and a bottom portion, wherein the top portion of the lift attachment link is fixedly attached to the seat frame;

a rear link that includes a upper end and a lower end, wherein the upper end of the rear link is rotatably coupled to the mid portion of the lift attachment link; and a lifting link that includes an upper end and a lower end, wherein the upper end of the lifting link is pivotably coupled to the bottom portion of the lift attachment link and the lower end of the lifting link is rotatably coupled to a respective seat-mounting plate.

10. The seating unit of claim 9, wherein the lift linkage mechanism further comprises a mounting link that includes a forward portion, a forward lift portion, a rearward lift portion, and a rearward portion, wherein the forward portion and the rearward portion are each fixedly attached to a respective seat-mounting plate, and wherein the forward lift portion of the mounting link is rotatably coupled to the lower end of the lifting link and the rearward lift portion of the mounting link is rotatably coupled to the lower end of the rear link.

11. A seating unit coupled to a seat frame configured to be raised with respect to the seating unit comprising:

a pair of arms;

a pair of base plates in substantially parallel-spaced relation;

a pair of seat-mounting plates in substantially parallel-spaced relation, wherein a seat of the seating unit extends between a seat linkage mechanism adapted to translate the base plates with respect to the seat-mounting plates when the seat is lowered;

a seat frame for supporting a seat of the seating unit;

a pair of generally minor image seat-lift assemblies, wherein the pair of generally mirror-image seat-lift assemblies are operably decoupled from the arms, to raise the seat frame independently of the seat linkage mechanism, the seat-lift assemblies comprising:

a pair of generally minor-image drive linkage mechanisms each moveably interconnecting the seat frame to the base plates, respectively, and adapted to independently raise at least a first portion of the seat frame in relation to a respective base plate, the first portion of the seat frame being raised at a first rate; and a pair of generally mirror-image lift linkage mechanisms each moveably interconnecting the seat frame to the seat-mounting plates, respectively; adapted to independently raise at least a second portion of the seat frame in relation to a respective seat-mounting plate, the second portion of the seat frame being raised at a second rate, wherein the first rate is different from the second rate.

12. The seating unit of claim 11, wherein the first rate is faster than the second.

13. The seating unit of claim 11, wherein the drive linkage mechanisms and the lift linkage mechanisms simultaneously raise the seat frame in relation to the base plates and the seat-mounting plates.

14. The seating unit of claim 11, wherein the each of the seat-lift assemblies further comprises:

the drive linkage mechanism that includes:

a drive attachment link that includes a top portion and a bottom portion, wherein the top portion of the drive attachment link is rotatably coupled to the seat frame;

an extension link that includes a front portion, a mid portion, and a rear portion, wherein the rear portion of the extension link is pivotably coupled to the bottom portion of the drive attachment link;

a motor link that includes a top portion and a bottom portion, wherein the top portion of the motor link is rotatably coupled to the mid portion of the extension link;

a bell crank that includes a top portion and a bottom portion, wherein the top portion of the bell crank is rotatably coupled to the front portion of the extension link; and a drive sequence link that includes a top portion and a bottom portion, the bottom portion of the drive sequence link is rotatably coupled to the bottom portion of the bell crank and rotatably coupled to a respective base plate;

the lift linkage mechanism that includes:

a lift attachment link that includes an top portion, a mid portion, and a bottom portion, wherein the top portion of the lift attachment link is fixedly attached to the seat frame;

a rear link that includes an upper end and a lower end, wherein the upper end of the rear link is rotatably coupled to the mid portion of the lift attachment link; and a lifting link that includes an upper end and a lower end, wherein the upper end of the lifting link is pivotably coupled to the bottom portion of the lift attachment link and the lower end of the lifting link is rotatably coupled to a respective seat-mounting plate.

15. The seating unit of claim 11, wherein the seat-lift assemblies are drivably coupled to a linear actuator automatically raises the seat frame independently of the seat linkage mechanism.

16. The seating unit of claim 15, wherein the linear actuator is further adapted to automatically lower the seat frame.

17. A seat-lift assembly operably coupled to a seat frame to raise the seat frame, the seat-lift assembly comprising:

a drive linkage mechanism moveably interconnecting a base plate to the seat frame and operably coupled to the seat frame to raise at least a first portion of the seat frame in relation to the base plate, the first portion of the seat frame being raised at a first rate; and a linkage mechanism moveably interconnecting a seat-mounting plate to the seat frame and operably coupled to the seat frame to raise at least a second portion of the seat frame in relation to the seat-mounting plate, the second portion of the seat frame being raised at a second rate, wherein the first rate is different from the second rate.

18. The seat-lift assembly of claim 17, wherein the seat-lift assembly further comprises:

the drive linkage mechanism that includes:

a drive attachment link that includes a top portion and a bottom portion, wherein the top portion of the drive attachment link is rotatably coupled to the seat frame;

an extension link that includes a front portion, a mid portion, and a rear portion, wherein the rear portion of the extension link is pivotably coupled to the bottom portion of the drive attachment link;

a motor link that includes a top portion and a bottom portion, wherein the top portion of the motor link is rotatably coupled to the mid portion of the extension link;

a bell crank that includes a top portion and a bottom portion, wherein the top portion of the bell crank is rotatably coupled to the front portion of the extension link; and a drive sequence link that includes a top portion and a bottom portion, the bottom portion of the drive sequence link is rotatably coupled to the bottom portion of the bell crank and rotatably coupled to a respective base plate;

the lift linkage mechanism that includes:

a lift attachment link that includes a top portion, a mid portion, and a bottom portion, wherein the top portion of the lift attachment link is fixedly attached to the seat frame;

a rear link that includes a upper end and a lower end, wherein the upper end of the rear link is rotatably coupled the mid portion of the lift attachment link; and a lifting link that includes an upper end and a lower end, wherein the upper end of the lifting link is pivotably coupled to the bottom portion of the lift attachment link and the lower end of the lifting link is rotatably coupled to a respective seat-mounting plate.

19. The seat-lift assembly of claim 18, wherein the seat frame for supporting the seat is coupled to the seat-lift assembly, the seat frame comprising:

a rear cross member, a front cross member, a first lateral member, and a second lateral member, wherein the rear cross member of the seat frame is coupled to the top portion of the drive attachment link and the first lateral member of the seat frame is coupled to a top portion of the lift linkage mechanism.

20. The seat-lift assembly unit of claim 19, wherein the motor link is rotatably coupled to a linear actuator that automatically raises and lowers the seat frame independently of a seat linkage mechanism.

* * * * *